US006153046A

United States Patent [19]

Kung

[11] Patent Number: 6,153,046

[45] Date of Patent: Nov. 28, 2000

[54] APPARATUS FOR APPLYING ADHESIVE TAPE

[76] Inventor: Joe Kung, 13403 Beach St., Cerritos, Calif. 90703

[21] Appl. No.: 09/306,698

[22] Filed: May 6, 1999

[51] Int. Cl.[7] ..... B31F 5/06

[52] U.S. Cl. ..... 156/459; 156/443; 156/461; 156/510

[58] Field of Search ..... 156/443, 459, 156/461, 468, 475, 484, 510, 523

[56] References Cited

U.S. PATENT DOCUMENTS

| | | | |
|---|---|---|---|
| 3,812,588 | 5/1974 | Bennett . | |
| 3,905,859 | 9/1975 | Patterson | 156/443 |
| 4,097,328 | 6/1978 | Urushizaki . | |
| 4,718,971 | 1/1988 | Summers . | |
| 4,857,134 | 8/1989 | Lin . | |
| 5,236,540 | 8/1993 | Shi . | |
| 5,641,377 | 6/1997 | Chung et al. . | |
| 5,788,807 | 8/1998 | Gratz . | |
| 5,802,695 | 9/1998 | Willoughby . | |
| 5,806,714 | 9/1998 | Geiger . | |
| 5,846,175 | 12/1998 | Chen . | |

*Primary Examiner*—Michael W. Ball
*Assistant Examiner*—Jessica Rossi
*Attorney, Agent, or Firm*—Chan Law Group, LC; Marcia Devon

[57] ABSTRACT

An adhesive tape cutting and folding apparatus generally comprising a main wheel, means for cutting the adhesive tape, means for advancing the main wheel, and means for folding a strip of adhesive tape over a working piece. The main wheel includes a plurality of radially disposed folding slots that open adjacent the periphery of the main wheel. Adhesive tape from a standard roll is spooled around the main wheel, wherein the adhesive side of the tape faces radially outwards. As the working piece is pushed into a slot, the cutting means is actuated severing a piece of tape from the supply roll. As the piece of tape is cut, the tape folding means, which is disposed within the slot, folds and applies the severed piece of tape over the working piece. As the working piece is withdrawn from the slot, the indexing means advances the main wheel to position another folding slot and fresh section of adhesive tape.

19 Claims, 5 Drawing Sheets

APPARATUS FOR APPLYING ADHESIVE TAPE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to adhesive tape applicators, and more generally to an apparatus that automatically cuts, folds, and applies adhesive tape.

2. Description of the Background Art

Methods for sealing pamphlets, catalogs, magazines, flyers, and miscellaneous paper mailers typically involve stapling, manually cutting and folding strips of adhesive tape, manually peeling pre-cut labels from label rolls, and/or using expensive and complicated adhesive tab sealing machines. The aforementioned methods, however, have one or more of the following inherent disadvantages: stapling is prohibited by the postal service; manually cutting and folding strips of adhesive tape require extensive manpower; peeling pre-cut labels also require significant manpower in addition to causing waste from the discarded label backings; and adhesive tab sealing machines are expensive to own and maintain.

Using adhesive tape generally helps solve some of the aforementioned problems. Adhesive tape is inexpensive, widely available, and has numerous domestic and commercial uses. To meet these numerous needs, a wide variety of adhesive tape applicators or dispensers have been designed. The most common type of adhesive tape dispenser uses a housing to hold a roll of adhesive tape and provides for a tape cutting mechanism. To use such dispensers, the user pulls the adhesive tape to the desired length, cuts off a segment, and applies the adhesive tape segment over the desired item. Such dispensers are unable to automatically cut a segment of the adhesive tape, nor can they fold or apply the segment of adhesive tape over the item.

Another common type of applicator uses a handle attached to an adhesive tape supply spool and a cutting mechanism. These applicators provide for applying adhesive tape linearly to the upper surface for joining two flat sections in a juxtaposed manner. To use such applicators, the user initially attaches the leading end of the adhesive tape to one end of the section to be taped, pulls the applicator across the section to be taped causing the adhesive tape to be applied, and finally cuts off the adhesive tape adjacent the opposing end of the taped section. Such applicators, however, are unable to fold the adhesive tape for attaching or sealing items stacked above one another, and they cannot automatically cut the adhesive tape.

Therefore, there is a need for an adhesive tape applicator capable of automatically cutting a segment of adhesive tape, folding the segment of adhesive tape over the item to be taped, and applying the folded adhesive tape securely over the item. The present invention satisfies these needs, as well as others, and generally overcomes the deficiencies existing in the presently known devices.

BRIEF SUMMARY OF THE INVENTION

The present invention pertains generally to an apparatus for cutting, folding, and applying adhesive tape onto an item to be taped. By way of example and not of limitation, the invention generally comprises a main wheel, means for cutting the adhesive tape, means for advancing or rotating the main wheel, and means for folding a strip of adhesive tape over an item to be taped.

The main wheel includes a plurality of radially disposed folding slots that open adjacent the periphery of the main wheel. Adhesive tape from a standard roll is spooled around the main wheel, wherein the adhesive side of the tape faces radially outwards. As the item to be taped is pushed into a folding slot, the cutting means is actuated severing a piece of tape from the supply roll. As a segment of tape is cut, the tape folding means, which is disposed within the slot, folds, and applies the segment of tape over the item to be taped. As the item is withdrawn from the slot, the rotating means advances the main wheel to position another folding slot and fresh section of adhesive tape. To enhance the effectiveness of the cutting means, a plurality of cutting slots are positioned on the main wheel between each folding slot. The cutting slots are adapted for receiving a cutting blade therein of the cutting means, while the adhesive tape is being cut.

The invention further comprises an indexing means for precisely controlling the amount of rotation of the main wheel. This allows for reliably positioning a folding slot adjacent an opening through which the item is fed.

An object of the invention is to provide an apparatus that automatically cuts a segment of adhesive tape from a standard supply roll of adhesive tape.

Another object of the invention is to provide an apparatus that automatically folds a cut segment of adhesive tape over an item to be taped together.

Still another object of the invention is to provide an apparatus that securely applies a cut segment of adhesive tape onto an item to be taped.

Still another object of the invention is to provide an adhesive tape applicator that can be manufactured economically and which functions reliably.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 11. It will be appreciated that the apparatus may vary as to configuration and as to details of the parts without departing from the basic concepts as disclosed herein.

Figure 1:
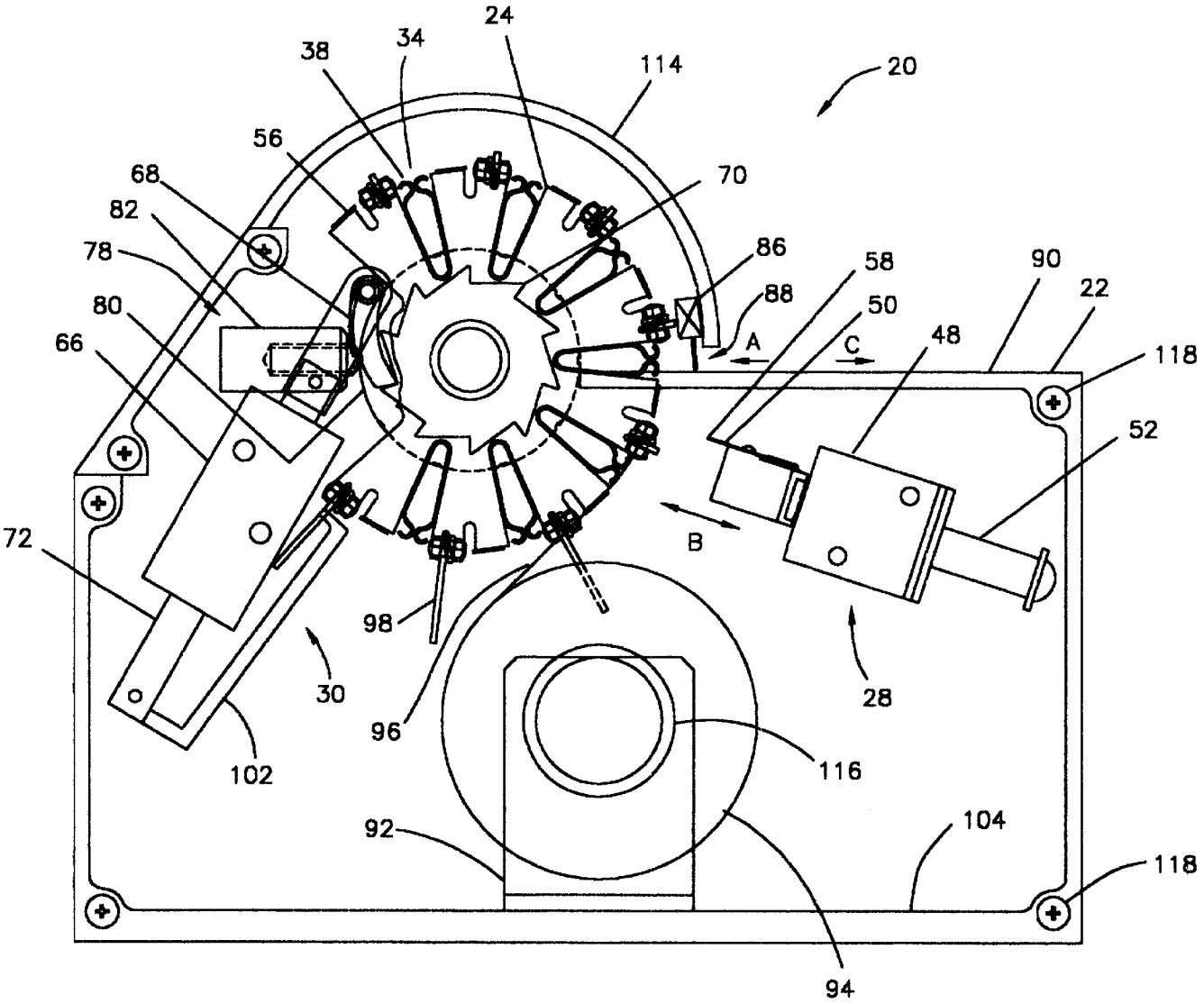
FIG. 1 is a side elevational view of the internal mechanism of an apparatus for applying adhesive tape, in accordance with the present invention.
Figure 2:
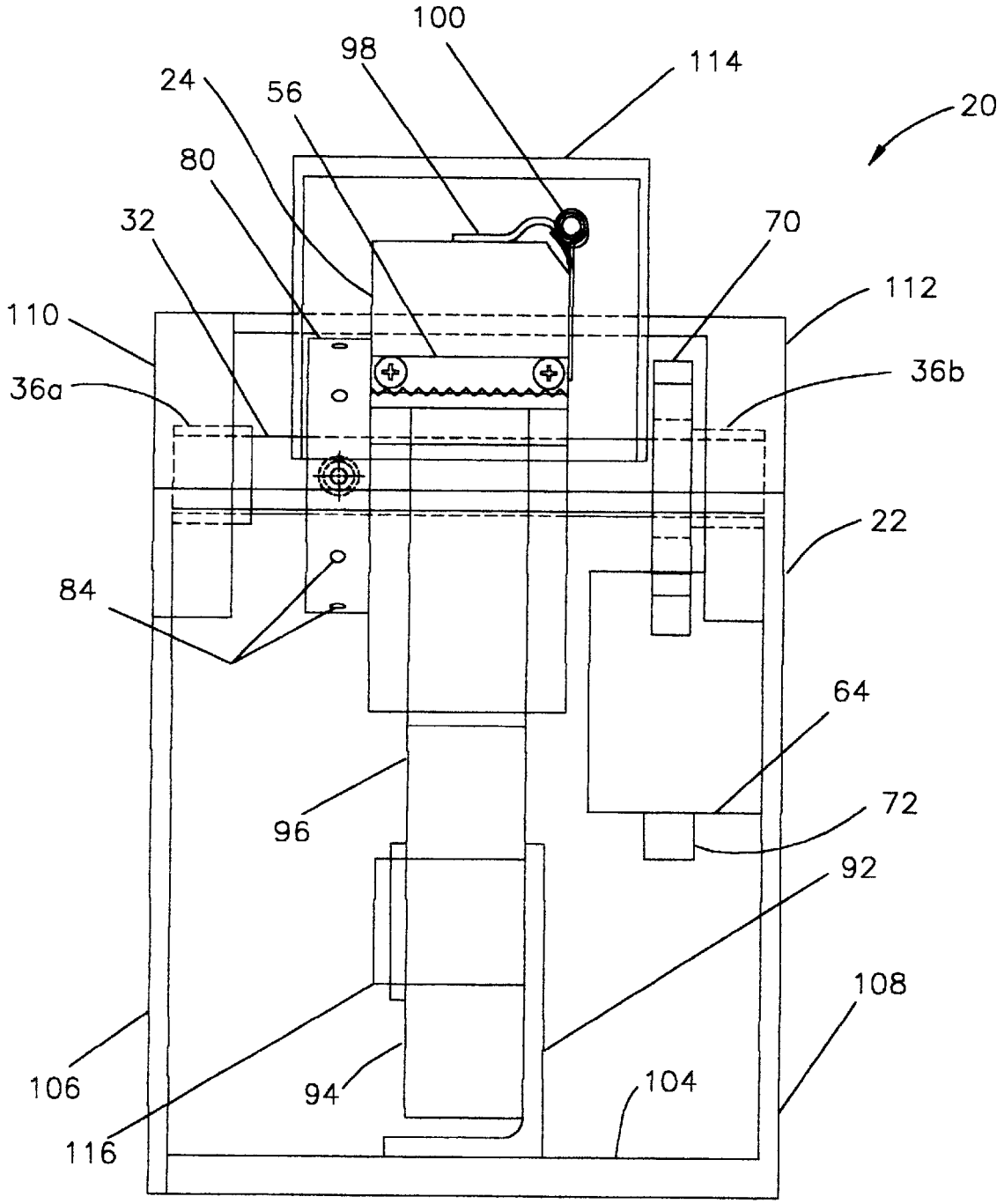
FIG. 2 is a front view of the internal mechanism of the apparatus for applying adhesive tape shown in FIG. 1 with the means of cutting adhesive tape not shown.
Figure 3:
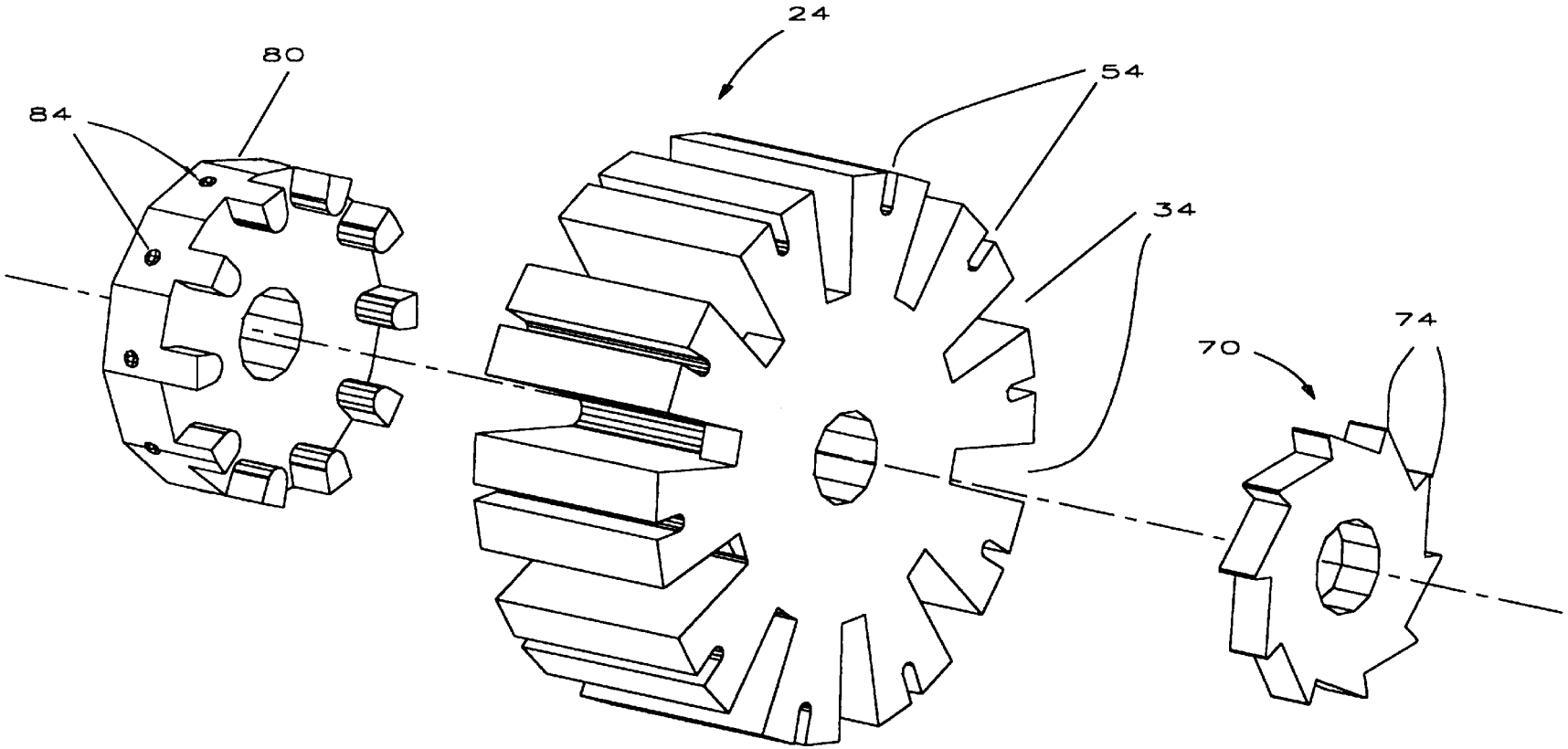
FIG. 3 is a perspective view of a main wheel, ratchet wheel, and spacer shown in FIG. 1 and FIG. 2.

Referring to FIG. 1 through FIG. 11, an apparatus 20 for cutting, folding, and applying adhesive tape, in accordance with the present invention, is generally shown. Apparatus 20 comprises a housing 22, a main wheel 24, a means 26 for folding adhesive tape, a means 28 for cutting adhesive tape, and a means 30 for rotating the main wheel 24. Main wheel 24 is rotatably mounted on a support shaft 32 within housing 22 and includes a plurality of radially extending folding slots 34 that are generally spaced apart equally from each other, as shown in FIG. 3. Support shaft 32 is supported by a pair of bushings 36*a* and 36*b* within housing 22.

Figure 5:
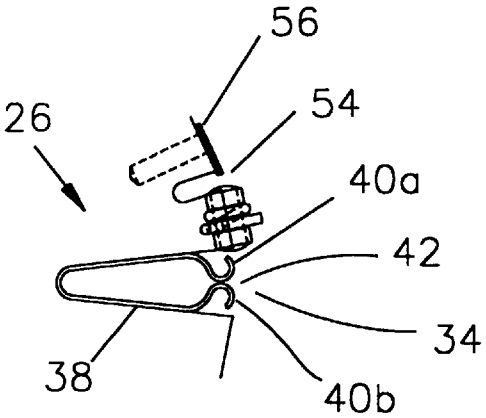
FIG. 5 is a side view of a folding slot and snap ring, along with a holding finger on a main wheel shown in FIG. 1.
Figure 11:
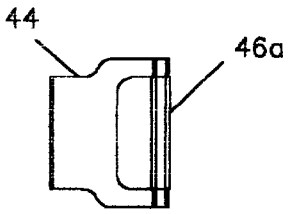
FIG. 11 is top view of the snap ring shown in FIG. 10.

Means 26 for folding adhesive tape is disposed within each folding slot 34, as shown in FIG. 5. In the preferred embodiment, means for folding adhesive tape comprises a snap spring 38 that has a pair of rounded edges 40*a* and 40*b* concealing an opening 42. Rounded edges 40*a* and 40*b* are biased to a closed position as shown, thereby concealing opening 42 of snap spring 38. Rounded edge 40*a* and 40*b* facilitate the receipt and compression of a generally flat item inserted therein. As an alternate embodiment shown in FIG. 10 and FIG. 11, snap spring 44 incorporates a pair of opposing rollers 46*a* and 46*b* mounted on pins to facilitate receipt and compression of thinner flat items.

Figure 4:
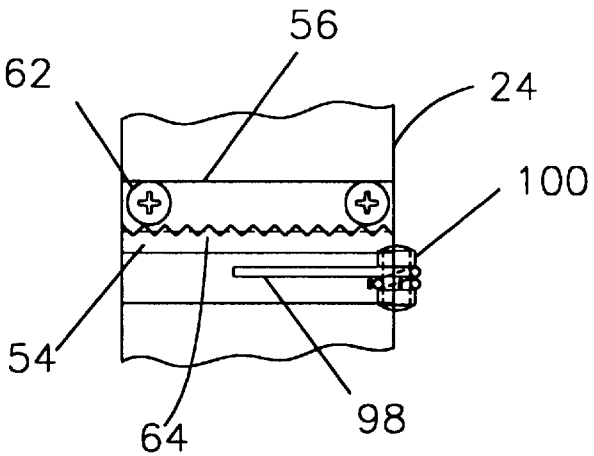
FIG. 4 is a top view of a jagged-edge blade and a holding finger on a main wheel shown in FIG. 1.
Figure 9:
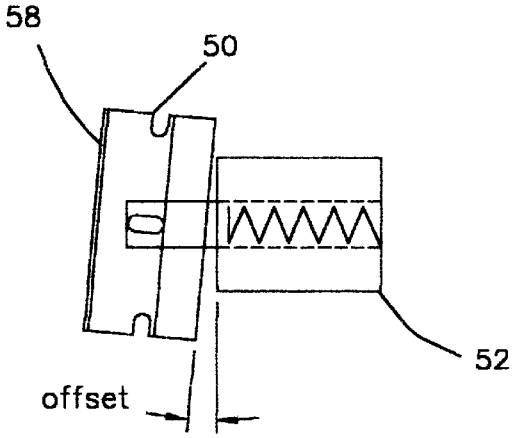
FIG. 9 is a top view of a means for cutting adhesive tape shown in FIG. 1.

Means 28 for cutting adhesive tape is disposed proximal to main wheel 24 and comprises a first solenoid 48 and a cutting blade 50. First solenoid 48 includes a push piston 52 onto which cutting blade 50 is attached. Main wheel 24 incorporates a plurality of cutting slots 54 and an equal plurality of jagged edge blades 56. Cutting slots 54 are disposed generally between folding slots 34 and are adapted to receive the cutting edge 58 of cutting blade 50 therein. Jagged edge blade 56 is attached to main wheel 24 by set screws 62, or the like, as shown in FIG. 4. Jagged edge blade 56 is positioned adjacent each said cutting slot 54 such that each jagged edge blade 56 is generally perpendicular to cutting blade 50 when cutting blade 50 enters cutting slot 54. For optimum cutting effectiveness, the edge 64 of jagged edge blade 56 is maintained as close as possible to cutting blade 50 when cutting blade 50 is inserted into cutting slot 54. To improve the cutting effectiveness, cutting blade 50 is offset, as shown in FIG. 9, with its cutting edge 58 angled between approximately 5 degrees to 10 degrees from the rotational axis of main wheel 24, and hence, the surface of the adhesive tape being cut. This offset provides for a slicing effect rather than merely chopping the adhesive tape, thereby resulting in a faster, more precise cut.

Figure 8:
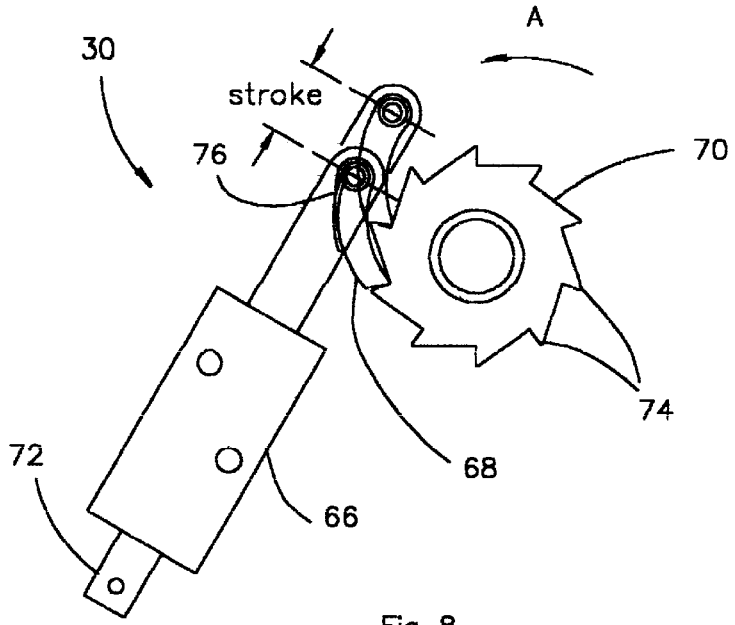
FIG. 8 is a side view of a means for rotating the main wheel shown in FIG. 1.
Figure 10:
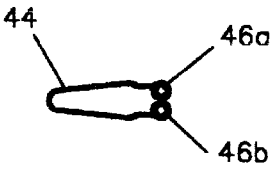
FIG. 10 is an alternate embodiment of a snap ring in accordance with the present invention.

In FIG. 8, it can be seen that means 30 for rotating main wheel 24 comprises a second solenoid 66, a pull paw 68, and a ratchet wheel 70. Second solenoid 66 includes a pull piston 72 onto which pull paw 68 is pivotally attached. Ratchet wheel 70 includes a plurality of teeth 74 and is concentrically attached to main wheel 24. Second solenoid 66 is proximally disposed to main wheel 24 such that pull paw 68 engages teeth 74 of ratchet wheel 70. A torsion spring 76 biases pull paw 68 against teeth 74 of ratchet wheel 70. The angle of teeth 74, along with the configuration of pull paw 68, permit rotation of ratchet wheel 70 only in the direction indicated by arrow A.

Apparatus 20 further comprises a means 78 for indexing main wheel 24. Means 78 for indexing main wheel 24 comprises a spacer 80 and a ball plunger 82. Spacer 80 is concentrically attached to main wheel 24 and includes a plurality of spaced-apart indentations 84 disposed thereon, as shown in FIG. 3. The spacing between each indentation 84 is aligned with the spacing between each folding slot 34. Ball plunger 82 abuts spacer 80 and intermittently engages indentations 84 during the rotation of main wheel 24. Spacer 80 also serves to retain snap springs 38 or 44 in place within folding slot 34.

Figure 7:
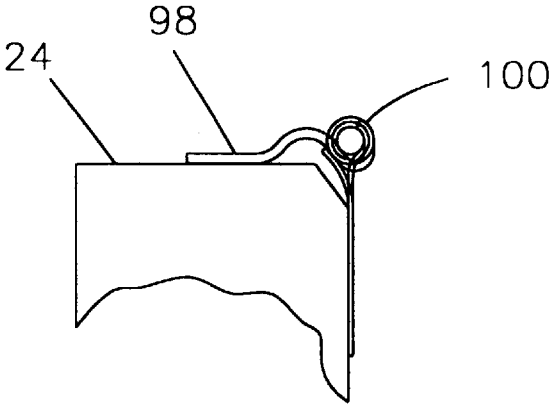
FIG. 7 is a front view of the holding finger in a closed position.
Figure 6:
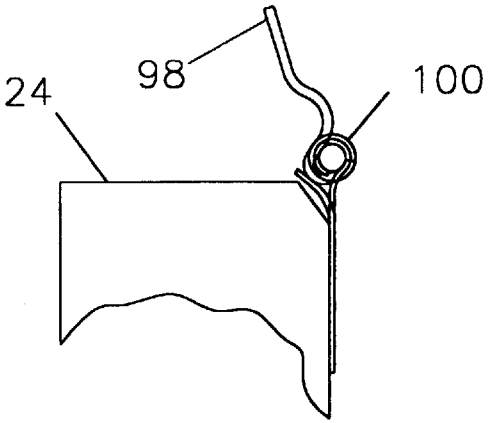
FIG. 6 is a front view of the holding finger in an open position.

Housing 22 of apparatus 20 further comprises limit switch 86 that controls the actuation of both first solenoid 48 and second solenoid 66. Limit switch 86 is placed adjacent an opening 88 in housing 22 that is configured to receive a generally flat item inserted therein. A relatively planar surface 90 is provided on housing 22 extending towards opening 88 and serves as a feed ramp for items being inserted therein. A bracket 92 within housing 22 provides for the attachment of an adhesive tape roll 94, which is of the type commonly known and available, such as cellophane tape. When adhesive tape roll 94 is installed on bracket 92, adhesive tape 96 is suspended across to main wheel 24 wherein the adhesive side of adhesive tape 96 faces outward and wherein the distal end of adhesive tape 96 is held onto main wheel 24 by a holding finger 98. Holding finger 98 is pivotally attached onto main wheel 24 by a spring latch 100. Holding finger 98 is movable between an open position as shown in FIG. 6 and a closed position as shown in FIG. 7. A retractor arm 102 attached to pull piston 72 of second solenoid 66 serves to retract holding finger 98 to the open position upon actuation of second solenoid 66 to rotate main wheel 24.

In the preferred embodiment of apparatus 20, housing 22 typically comprises a base 104, a pair of lower side covers 106 and 108, a pair of upper side covers 110 and 112, a top cover 114, and a mandrel 116 on bracket 92. Lower side cover 106 can be fastened by screws 118, or the like. Base 104, lower side covers 106 and 108, upper side covers 110 and 112, and top cover 114 are preferably fabricated from substantially rigid but relatively lightweight material such as plastic, aluminum, or the like. Power for driving both first solenoid 48 and second solenoid 66 may be derived from dry cell disposable batteries, rechargeable batteries, or standard household AC power. Use of solenoids is disclosed in the preferred embodiment since solenoids economically provide fast, reliable response. However, those skilled in the art will appreciate that main wheel 24 and cutting means 28 may also be driven by a motor in combination with a gear train or a belt and pulley arrangement.

The operation of apparatus 20 is hereinafter described through one cycle of adhesive taping. Upon insertion of an item for adhesive taping, such as a paper mailer or the like, along planar surface 90 of housing and into opening 42, as shown by arrow A in FIG. 1, limit switch 86 actuates first solenoid 48 to drive push piston 52 and cutting blade 50 towards main wheel 24. The direction of motion of cutting blade 50 is shown by bi-directional arrow B. Cutting blade 50 severs adhesive tape 96 into a precise segment as cutting blade 50 enters cutting slot 54. During the cutting operation, push piston 52 also moves holding finger 98 to its closed position, as shown in FIG. 7, which secures adhesive tape 96 onto main wheel 24. As the paper mailer progresses through opening 42 towards folding slot 34, rounded edges 40*a* and 40*b* guide the mailer into opening 42 of snap spring 38. As mailer enters snap spring 38, rounded edges 40*a* and 40*b* fold and compress the segment of cut adhesive tape onto the mailer. The mailer is thereafter withdrawn from folding slot 34 back through opening 88, as shown by arrow C.

Removal of the paper mailer from opening 42 causes limit switch 86 to actuate second solenoid 66. Pull piston 72 of second solenoid retracts as shown in FIG. 8. As pull piston 72 retracts, pull paw 68 moves teeth 74 of ratchet wheel 70, thereby rotating ratchet wheel 70 as well as main wheel 24. The amount of rotation of main wheel 24 is precisely controlled by means 78 for indexing mail wheel 24. As main wheel 24 and spacer 80 rotate, ball plunger 82 engages the next indentation 84, thereby restricting further rotation of main wheel 24. It can be seen that the spacing between each successive indentation 84 determines the amount of main wheel 24 rotation per given single actuation of second solenoid 66. Since the spacing between each indentation 84 is aligned with the spacing between each folding slot 34, rotation of main wheel 24 advances a successive folding slot 34 to precisely adjacent opening 88 of housing 22. The actuation of pull piston 72 also causes retractor arm 102 to retract holding finger 98 to an open position, as shown in FIG. 6. The open position readies the securement of additional adhesive tape 96 onto main wheel 24. It is contemplated that the manual insertion of the items for taping into opening 88 may be automated by combining apparatus 20 with a feed system (not shown) such as a roller assembly for continuously delivering the items into opening 88 and depositing the taped item in a receptacle of the like. To assure fast rotational and indexing response of main wheel 24, main wheel must have a low rotational inertia. Thus, main wheel 24 preferably fabricated from any of a variety of lightweight materials that reduces weight and therefore its rotational inertia.

To load adhesive tape roll 94 on bracket 92, lower side cover 106 and top cover 114 are removed. Adhesive tape roll can then be mounted onto mandrel 116. A section of adhesive tape 96 is pulled to and placed on main wheel 24 with the adhesive side facing outward. Holding finger 98 must be manually pushed to the closed position over the leading end of adhesive tape 96 to secure adhesive tape 96 onto main wheel 24. Subsequently, lower side cover 106 and top cover 114 are replaced and apparatus 20 is ready for operation.

Accordingly, it will be seen that this invention provides an apparatus for automatically applying adhesive tape onto paper mailers or the like wherein commonly available adhesive tape is cut, folded, and adhered onto the mailer upon the insertion of the mailer into the apparatus, thereby eliminating the need to cut a segment of adhesive tape, hold multiple section of the paper mailer together, and apply the adhesive tape over the paper mailer.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for cutting, folding, and applying adhesive tape, comprising:

(a) a housing having an opening;

(b) a main wheel disposed within said housing, said main wheel including a plurality of radially disposed folding slots spaced equally apart from each other;

(c) means for folding adhesive tape, said adhesive tape folding means comprising a snap spring disposed within each said slot;

(d) means for cutting adhesive tape, said adhesive tape cutting means disposed proximal to said main wheel; and (e) means for rotating said main wheel.

2. An apparatus as recited in claim 1, wherein said adhesive tape cutting means comprises:

(a) a first solenoid; and (b) a cutting blade attached to said first solenoid, wherein actuation of said solenoid imparts said cutting blade towards said main wheel.

3. An apparatus as recited in claim 2, further comprising:

(a) a plurality of cutting slots on said main wheel, wherein each said cutting slot is adapted to receive said blade therein upon actuation of said solenoid; and (b) a plurality of jagged edge blades disposed on said main wheel, each said jagged edge blade positioned adjacent said cutting slot such that each said jagged edge blade is generally perpendicular to said cutting blade when said cutting blade enters said cutting slot.

4. An apparatus as recited in claim 2, wherein said cutting blade is offset relative to the rotational axis of said main wheel.

5. An apparatus as recited in claim 1, wherein said means for rotating said main wheel comprises:

(a) a ratchet wheel concentrically attached to said main wheel, said ratchet wheel including a plurality of teeth;

(b) a second solenoid proximally disposed to said main wheel; and (c) a pull paw attached to said second solenoid, said pull paw configured to engage said teeth of said ratchet wheel, wherein actuation of said second solenoid causes rotation of said main wheel.

6. An apparatus as recited in claim 1, further comprising a means for indexing the rotation of said main wheel such that one of said folding slots is maintained in direct communication with said opening of said housing.

7. An apparatus as recited in claim 6, wherein said main wheel indexing means comprises:

(a) a spacer concentrically attached to said main wheel, said spacer including a plurality of equally spaced apart indentations disposed thereon; and (b) a ball plunger disposed adjacent said spacer and configured to engage said indentations on said spacer, whereupon engagement of said ball plunger with each said indentation inhibits rotation of said main wheel.

8. An apparatus as recited in claim 1, further comprising a plurality of holding fingers for securing adhesive tape onto said main wheel.

9. An apparatus as recited in claim 1, further comprising a switch for actuating said first and said second solenoids, wherein said switch actuates said first solenoid upon insertion of an item for adhesive taping into said opening of said housing, and wherein said switch actuates said second solenoid upon removal of the item.

10. An apparatus for cutting, folding, and applying adhesive tape, comprising:

(a) a housing having an opening disposed thereon;

(b) a main wheel rotatably disposed within said housing, said main wheel including a plurality of radially disposed folding slots spaced equally apart from each other;

(c) a plurality of snap springs, each said snap spring disposed within each said slot;

(d) a cutting blade positioned angularly offset to the rotational axis of said main wheel;

(e) a first solenoid for actuating said cutting blade towards said main wheel;

(f) a ratchet concentrically attached to said main wheel; and (g) a second solenoid for rotating said main wheel, said second solenoid including a pull paw for engaging said ratchet, said pull paw pivotally attached to said second solenoid.

11. An apparatus as recited in claim 10, comprising:

(a) a plurality of cutting slots on said main wheel, wherein each said cutting slot is adapted to receive said cutting blade therein upon actuation of said solenoid; and (b) a plurality of jagged edge blades disposed on said main wheel, each said jagged edge blade positioned adjacent said cutting slot such that each said jagged edge blade is generally perpendicular to said cutting blade when said cutting blade enters said cutting slot.

12. An apparatus as recited in claim 10, further comprising a means for indexing said rotation of said main wheel.

13. An apparatus as recited in claim 12, wherein said main wheel indexing means comprises:

(a) a generally circular spacer concentrically attached to said main wheel, said spacer including a plurality of equally spaced apart indentations disposed thereon; and (b) a ball plunger disposed adjacent said spacer and configured to engage said indentations on said spacer, whereupon engagement of said ball plunger with each said indentation inhibits rotation of said main wheel.

14. An apparatus as recited in claim 10, further comprising a plurality of holding fingers for securing adhesive tape onto said main wheel.

15. An apparatus as recited in claim 10, further comprising a switch for actuating said first and said second solenoids, wherein said switch actuates said first solenoid upon insertion of an item for adhesive taping into said opening of said housing, and wherein said switch actuates said second solenoid upon removal of the item.

16. An apparatus for cutting, folding and applying adhesive tape, comprising:

(a) a housing having a opening disposed thereon;

(b) a main wheel rotatably disposed within said housing, said main wheel including a plurality of radially disposed folding slots spaced equally apart from each other, said main wheel further including an plurality of cutting slots disposed between each said folding slot;

(c) a plurality of snap springs disposed within each said slot, each said snap spring including an opening for receiving an item to be taped therein;

(d) a cutting blade disposed proximally to said main wheel, said cutting blade capable of insertion into said cutting slots, said cutting blade positioned angularly offset to the rotational axis of said main wheel;

(e) a first solenoid for actuating said cutting blade towards said cutting slots;

(f) a ratchet concentrically attached to said main wheel, said ratchet including a plurality of angled teeth therearound;

(g) a pull paw for engaging said teeth of said ratchet wheel;

(h) a second solenoid, said including a piston and a torsion spring, wherein said pull paw being pivotally attached to said piston and said torsion spring biasing said pull paw against said teeth of said ratchet wheel;

(i) a spacer concentrically attached to said main wheel, said spacer including a plurality of indentation disposed thereon; and (j) a ball plunger for engaging said spacer, wherein engagement of said ball plunger with said indentation inhibits rotational movement of said main wheel.

17. An apparatus as recited in claim 16, wherein said main wheel further comprises a plurality of jagged edge blades disposed adjacent each said cutting slot, said jagged edge blades positioned to be perpendicular to said cutting blade as said cutting blade enters each said cutting slot.

18. An apparatus as recited in claim 16, wherein said main wheel further comprises a plurality of holding fingers for securing adhesive thereon.

19. An apparatus as recited in claim 16, further comprising a switch for actuating said first solenoid upon insertion of an item into said opening of said housing and for actuating said second solenoid upon removal of the item from said opening of said housing.

* * * * *